US005206610A

United States Patent [19]

Nelson

[11] Patent Number: 5,206,610

[45] Date of Patent: Apr. 27, 1993

[54] TRANSFER DEVICE FOR COMBINING AND SWITCHING MICROWAVE SIGNAL USING A ROTARY WAVEGUIDE SWITCHING STRUCTURE

[76] Inventor: Victor Nelson, 8 Midvale Ct., East Northport, N.Y. 11731

[21] Appl. No.: 709,311

[22] Filed: Jun. 3, 1991

[51] Int. Cl.[5] ..... H01P 1/10

[52] U.S. Cl. ..... 333/106; 333/108

[58] Field of Search ..... 333/106, 108, 258

[56] References Cited

U.S. PATENT DOCUMENTS

| | | | |
|---|---|---|---|
| 2,769,144 | 10/1956 | Walters | 333/106 |
| 2,912,694 | 11/1959 | Phillips, Jr. | 333/108 X |
| 4,242,652 | 12/1980 | Shishido et al. | 333/106 |
| 4,366,452 | 12/1982 | Dittman et al. | 333/108 |
| 4,761,622 | 8/1988 | Cracknell et al. | 333/106 |
| 4,891,613 | 1/1990 | Nelson | 333/108 |

FOREIGN PATENT DOCUMENTS

| | | | |
|---|---|---|---|
| 720589 | 3/1980 | U.S.S.R. | 333/106 |

*Primary Examiner*—Paul M. Dzierzynski
*Assistant Examiner*—Benny Lee
*Attorney, Agent, or Firm*—Edward H. Loveman

[57] ABSTRACT

A transfer device for selectively combining and switching microwave signals between selective ports in a housing in which is a cylindrical rotor. In a lower portion of the rotor is a first passage having three arms each of which terminates at one of the ports when the rotor is one position so that microwave signals entering the passage via two of the arms are combined and leave the rotor and housing via the third arm. In an upper portion of the rotor are second and third passages which are blocked when the rotor is in the first position to prevent switching of signals therein When the rotor is in the second and third positions the second and third passages pass microwave signals between selected pairs of ports, while the arms of the first passage are blocked to prevent combining of signals therein.

10 Claims, 3 Drawing Sheets

FIG. 7
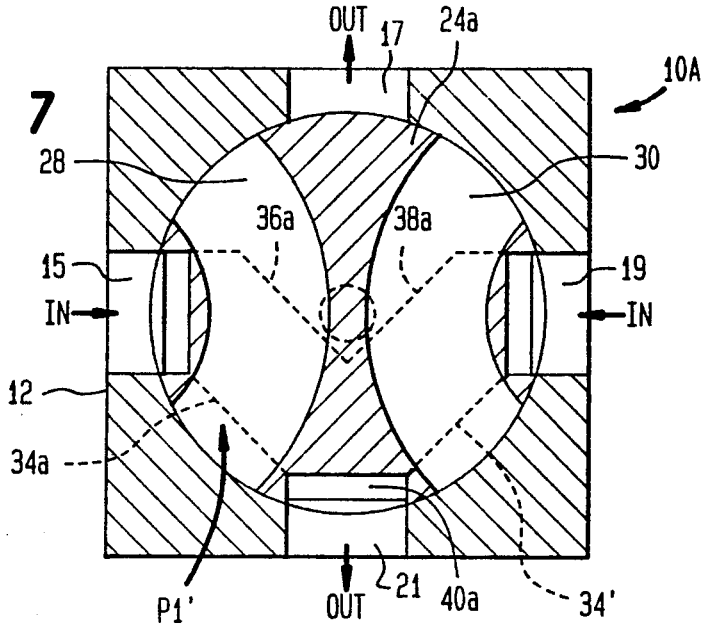
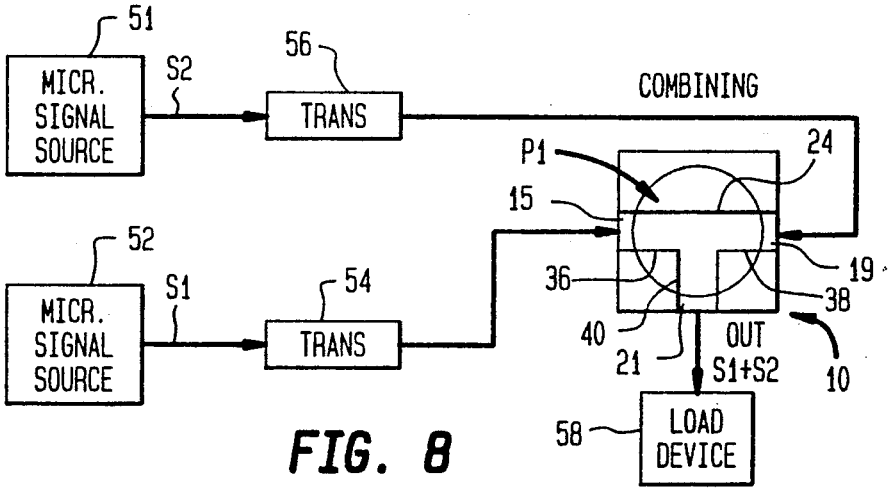
FIG. 8
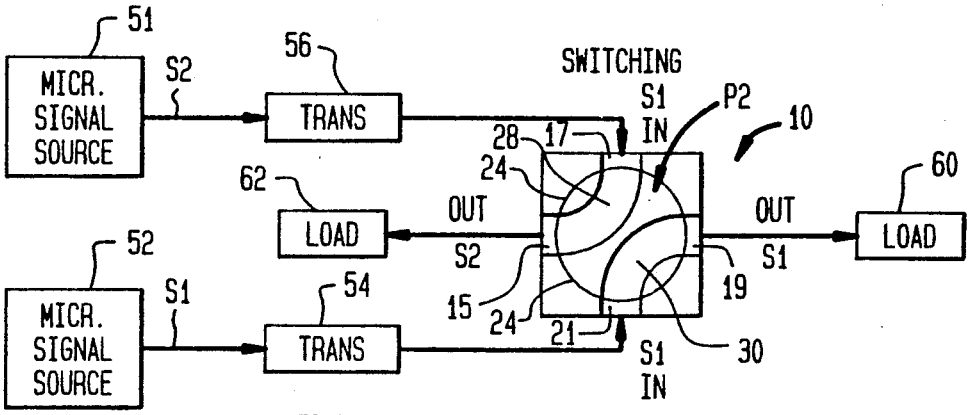
FIG. 9

TRANSFER DEVICE FOR COMBINING AND SWITCHING MICROWAVE SIGNAL USING A ROTARY WAVEGUIDE SWITCHING STRUCTURE

BACKGROUND OF THE INVENTION

1. Field of

This invention relates to the art of transfer devices used to combine and switch microwave signals traveling in different paths to and from microwave antennas, transmitters, receivers and other microwave loads and more particularly the invention concerns a small, simple, efficient, lightweight microwave transfer device operated by turning a rotor to different selected positions, to selectively switch microwave signals to pass in selected microwave transmission paths, and to combine microwave signals in transmission paths independent of the switching paths.

2. Description of the Prior Art

Heretofore, microwave transfer devices used as microwave signal combiners have been rather large, heavy, complicated, expensive assemblies, fixed in parameters so that they could not be switched from one microwave path to another. The prior microwave switches such as that described in U.S. Pat. No. 4,242,652 is typical, have not been capable of serving as signal combiners. One transfer device for combining and switching microwave signals was proposed in U.S. Pat. No. 4,891,613. This device had a hollow body with axially reciprocatable shorting pins selectively insertable into passages in the body to close off the passages. By proper selective insertion and retraction of the pins, microwave signals applied at input openings in the body could be combined or switched at output openings. This prior transfer device had limited utility and applications because the presence of the shorting pins caused reflections and energy losses and reduced isolation between separate signal paths in the device.

SUMMARY OF THE INVENTION

It is a principal object of the present invention to provide a lightweight, relatively simple, transfer device which is small in size and low in cost to manufacture, which can serve selectively to combine or switch microwave signals between input and output ports in the device. Such a unit has particular utility in applications in satellites, space vehicles, and the like, where size and weight of microwave units must be minimized to the greatest possible extent. At the same time the units must be rugged and absolutely reliable in operation, since they are often operated by remote control from ground stations.

According to the invention, there is provided a transfer device which has a lightweight metal housing in which is a lightweight cylindrical metal rotor. The height of the housing is less than the diameter of the rotor to minimize size, weight, and complexity. The housing has four sides with four ports in the sides respectively. Inside the housing at a lower portion of the rotor is a microwave transmission passage having three branches or arms. The rotor can be turned to one position where two of the arms communicate with two inlet ports while a third arm communicates with an outlet port. Microwave signals can be applied to the inlet ports to combine in the passage and leave via the third arm and outlet port. The rotor has second and third passages in an upper level of the rotor to serve as signal switching functions. The second and third passages are blocked by parts of the housing when the rotor is in a first signal combining position. The rotor can be turned to second and third position to register ends of the second and third passages with selected pairs of the ports for signal switching purposes. In the second and third rotor positions, the lower first passage is blocked off from the inlet and outlet ports to prevent signal combining while signal switching is performed in the second and third rotor positions. The rotor can be turned to a fourth position for combining signals transmitted through other inlet and outlet ports, while the second and third passages are blocked by portions of the housing to prevent signal switching.

By the described arrangement, no leakage can occur between signal switching passages and between signal combining passages. The several passages are clear and unobstructed so that no reflections are generated to cause signal losses. The rotor can be turned by a stepping motor, servomotor or their suitable driving mechanism, to four discrete positions where ends of the passages align with selected ports in the device.

Parts of the device are machinable by precisions metal working machines. The transfer device are machinable by precision metal working machines. The transfer device is light in weight, small in size, rugged, reliable and simple in operation.

These and other objects and many of the attendant advantages of this invention will be readily appreciated as the same becomes better understood by reference to the following detailed description when considered in connection with the accompanying drawings in which:

BRIEF DESCRIPTION OF THE DRAWINGS

FIG. 7 is a horizontal sectional view taken along line 7—7 of FIG. 6, the rotor being shown in a first microwave signal combining position;

FIG. 8 is a diagram of a circuit employing the device arranged for combining microwave signals;

FIG. 9 is a diagram of a circuit employing the device for switching microwave signals;

DESCRIPTION OF THE PREFERRED EMBODIMENTS

Figure 1:
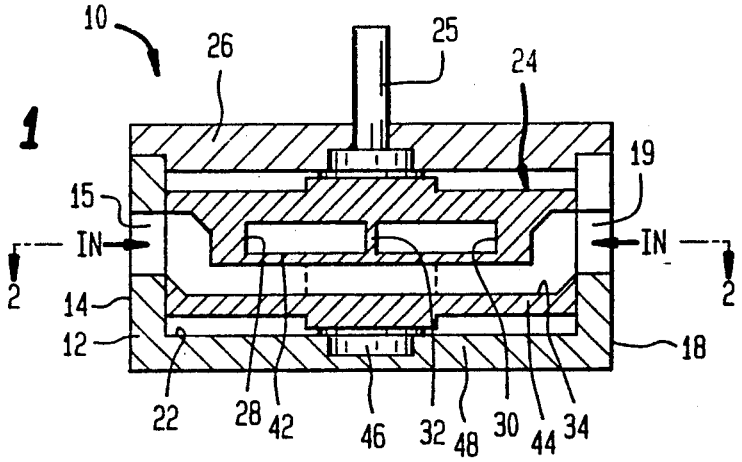
FIG. 1 is a central, vertical sectional view taken through a microwave signal combining and signal switching device embodying the invention, comprising a rectangular stator and cylindrical rotor.
Figure 2:
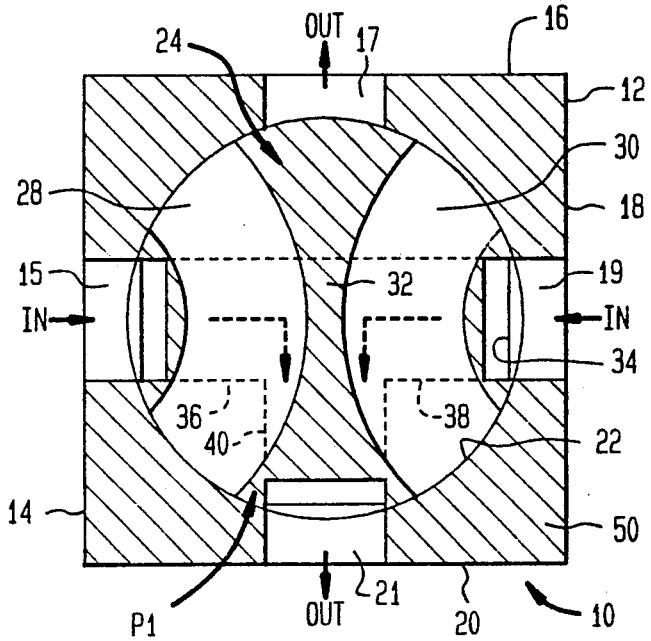
FIG. 2 is a horizontal sectional view taken along line 2—2 of FIG. 1, the rotor being shown in a first microwave signal combining position.
Figure 3:
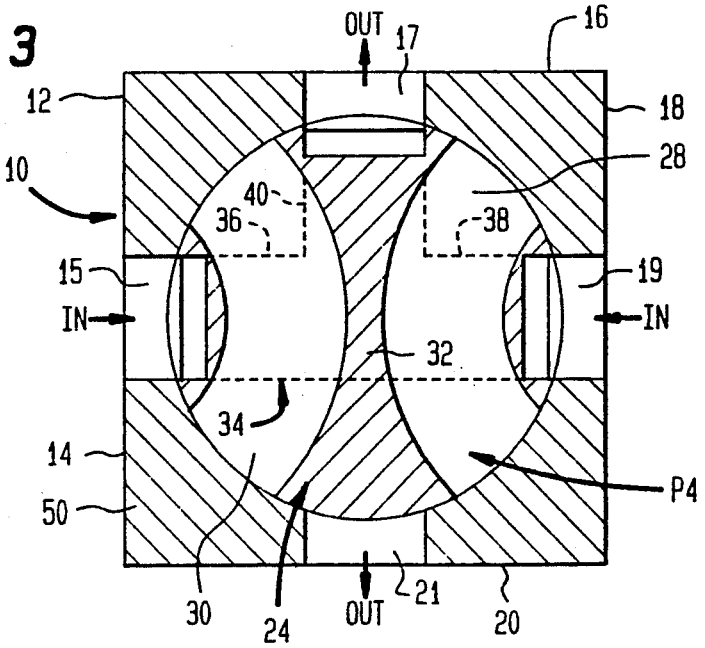
FIG. 3 is a view similar to FIG. 2, with rotor shown in a second microwave signal combining position.
Figure 4:
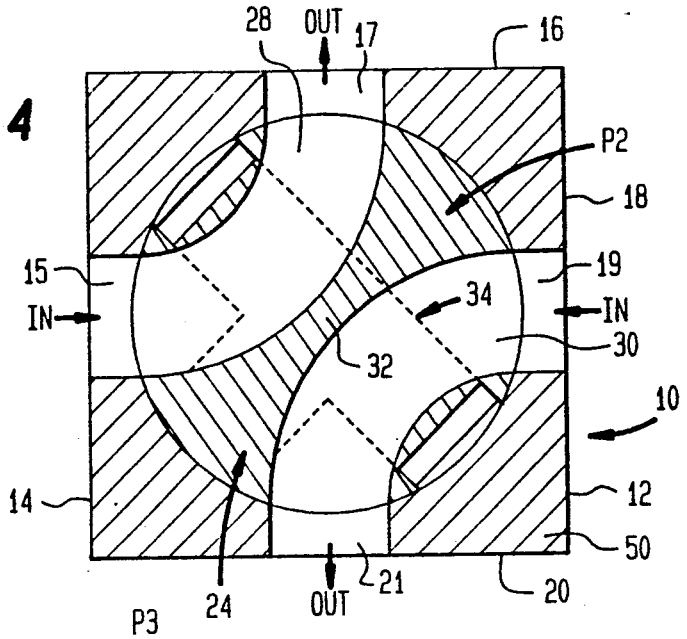
FIG. 4 and FIG. 5 are sectional views similar to FIGS. 2 and 3, with rotor shown in a microwave signal switching third and fourth positions respectively.
Figure 5:
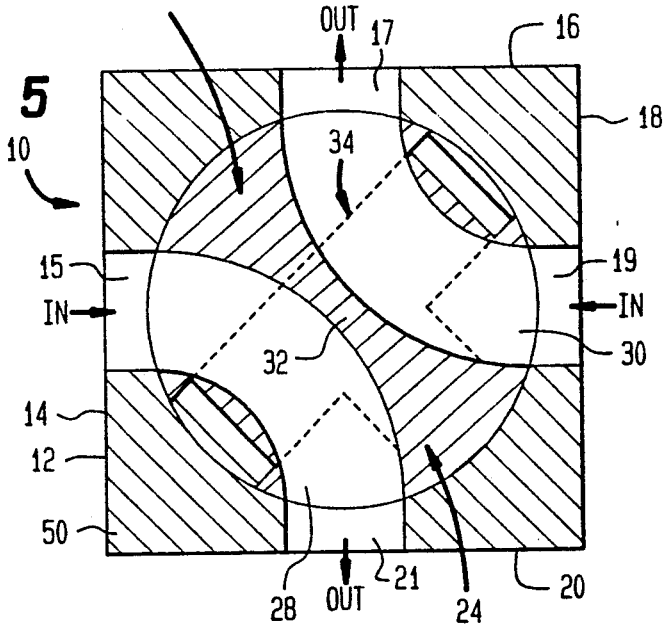

Referring now to the drawings wherein like reference characters designate like or corresponding parts throughout, there is illustrated in FIGS. 1-5, a transfer device generally designated by reference numeral 10, adapted to combine and switch microwave signals. The device 10 has a hollow rectangular casing 12 with four flat mutually perpendicular walls 14, 16, 18, 20. In each of the walls 14, 16, 18 and 20 is a respective signal input or output port 15, 17, 19, 21. The casing 12 has a cylindrical recess or chamber 22 (see FIG. 1) in which is a rotatable cylindrical rotor 24. The rotor 24 has an axial stem or shaft 25 (see FIG. 1) which can be turned by mechanical means to position the rotor 24 in any one of a plurality of detent positions shown in FIGS. 2 through 5, respectively. A rectangular cover plate 26 (see FIG. 1) is mounted on the open top of the casing 12 and is secured thereto by screws (not shown). In the rotor 24 are two arcuate or curved passages 28, 30 opposite ends of which may align with or register with the ports 15, 17 and 19, 21 as shown in FIG. 4 or with the ports 15, 21 and 17, 19 as shown in FIG. 5. The passages 28 and 30 are formed in an upper level of the rotor 24 and are separated by a web or partition 32 extending diametrally of the rotor 24. The rotor 24 is further formed with a passage 34 which is generally T-shaped in plan view as best shown in FIGS. 2 and 3. A pair of arms 36, 38 of the passage 34 extend in opposite directions an terminate at the ports 15 and 19 while a pedestal portion 40 (see FIG. 2, 3) of the passage 34, positioned 90° from the arms 36 and 38, opens into the port 17 or 21. The passage 34 extends underneath horizontal partition 42 of the rotor 24 and is defined between a partition 42 and a bottom wall 44 (see FIG. 1) of the rotor 24. The bottom wall 44 is journaled in a bearing 46 in the bottom wall 48 of the casing 12.

The device is arranged so that it can serve for combining microwave signals or alternatively for switching microwave signals. In FIG. 2, the rotor is shown in position P1. The ports 15 and 19 are employed here as microwave signal input ports IN. The microwave signals combine and leave the device 10 through the port OUT 21, here shown as an outlet port OUT. The arcuate passages 28 and 30 at the upper level are blocked off at opposite ends by abutting corner portions 50 of the casing 12. If it is desired to employ the device for microwave signal switching, the rotor 24 can be turned clockwise 45° to the position P2 of FIG. 4. Here opposite ends of the passage 28 will register with the inlet port 15 and the outlet port 17, while ends of passage 30 will register with the inlet port 19 and the outlet port 21. To switch the inlet and outlet of each of the passages 28 and 30, the rotor 24 can be turned clockwise 90° from the position show in FIG. 4 to the switching position P3 of FIG. 5. In both of the rotor positions P2 and P3, the lower passage 34 is blocked at all ends by corners 50 of the casing 12 and the walls 42,44 of the rotor 24.

If the rotor 24 is turned clockwise 180° from the position P1 in FIG. 2 to position P4 is FIG. 3 the device 10 will again serve as a signal combiner. The curved passages 28, 30 will be blocked by corner 50 of the casing 12, the T-shaped passage 34 will be inverted 180° from the position P1 and the pedestal portion or arm 40 of the passage 34 will be open at the outlet port 17. The signal inputs at the ports 15 and 19 are combined at the exit port 17. The outlet ports 17 and 21 will be connected to suitable microwave load devices such as receivers, 30 antennas, etc. The inlet ports 15 and 19 may be connected to suitable signal sources such as microwave transmitters, signal transmission antennas, etc.

Figure 6:
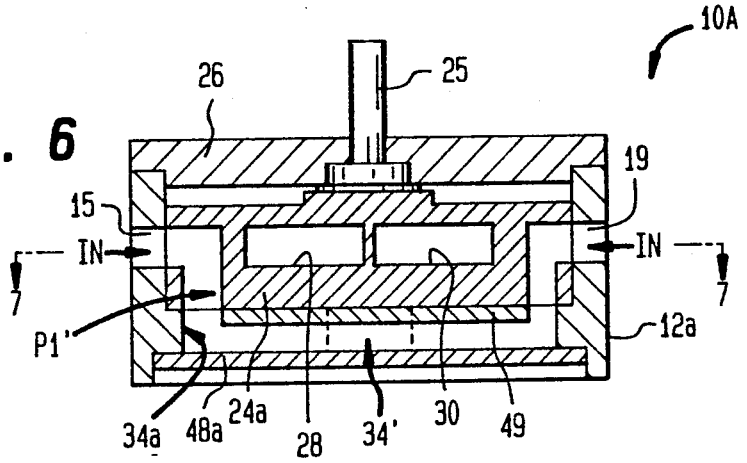
FIG. 6 is a central, vertical sectional view similar to FIG. 1. taken through as microwave signal combining and signal switching device embodying a modification of the invention.

In FIGS. 6 and 7 there is shown another transfer device 10A embodying modifications of the invention. Parts corresponding to those of the transfer device 10 of FIGS. 1–5 are identically or similarly numbered. The transfer device 10A has a rectangular casing **12*a* with four ports 15, 17, 19 and 21. Arcuate passages 28 and 30 are provided in a cylindrical rotor 24*a* at an upper level. A passage 34*a* has three intercommunicating arms 36*a*, 38*a* and 40*a* which communicate with ports 15, 19 and 21 in a first position P1' of a rotor 24*a*. The central portion of a passage 34*a* is generally Y-shaped and located at a level below that of the passages 28 30. A housing 12*a* has an open bottom closed by a plate 48*a* (see FIG. 6). When the plate 48*a* is absent, the bottom of the housing 12*a* may be accessed. This facilitates machining the central portion 34*a* of the passage 34. Thus the passage 34*a* is defined between the plate 48*a* and a horizontal partition 49 in the housing 12*a* (see FIG. 6) on upon which the rotor 24*a* is journaled. The axial height of the housing 12*a* is shorter than the diameter of the rotor 24*a*. This makes it possible to minimize the size and weight of the transfer device 10A which is essential for satellite and space travel applications. The shaft 25 extends through the top plate 26 and is connected to the top of the rotor 24*a* for turning the rotor 24*a* to each of four detent positions where the passages selectively communicate with selected ports in the housing 12*a* (see FIG. 6). The rotor 24*a* is shown in position P1' where the arcuate passages 28 and 30 are blocked to prevent signal switching, while the lower passage 34*a* permits input signals to be applied to ports 15 and 19 to leave from outlet port 21** as a combined signal.

FIG. 8 shows a diagram of transfer device 10 employed in signal combining mode. Microwave signal sources 51 and 52 apply microwave signals S1 and S2 to respective transmitters 54, 56 connected to the respective ports 15 and 19 used as inlets. The rotor 24 is in position 1 as explained in connection with FIG. 2. The combined signal output S1+S2 is taken from the output port 21 registering with the output arm 40 of the passage 34 which is at the lower level of the rotor 24, as best shown in FIG. 1. The output of the combined signal S1+S2 is applied to a suitable load device 58. The signal switching passages 28 and 30 are blocked as shown in FIG. 2.

FIG. 9 shows a diagram of the transfer device 10 employed in signal switching mode. The microwave sources 51 and 52 apply the signals S1 and S2 to the transmitters 54 and 56 which in turn feed signals S1 and S2 to respective input ports 21 and 17. The rotor 24 is in switching position P2. The signals pass through the passages 28 and 30 isolated from each other and exit via respective ports 19 and 15 to respective loads 60 and 62. In position P2 the branched passage 34 at the lower level of the rotor 24 is blocked as shown in FIG. 4, while the passages 28 and 30 in the upper level are unobstructed. By rotating the rotor 24 90° from the position P2 of FIGS. 4 and 9 to the rotor position P3 of FIG. 5 the signals S1 and S2 are switched from respective outlet ports 19 and 15 to respective outlet ports 21 and 17. The signal output S1 is applied to the load 60 and the signal output S2 is applied to the load 62. The transfer device 10 operates by alternately blocking the passage 34 and passages 28, 30 as the rotor 24 is turned successively through position P1, P2, P3 and P4.

It will be apparent that due to the relatively simple structure of the transfer device it can be operated by remote control of a stepping motor or servomotor connected to the drive shaft 25. Operation will be precise, with minimum signal losses due to reflections, and signal leakage between the several passages. The transfer device 10A operates like the device 10 so no further explanation of its modes of operation is required.

It should be understood that the foregoing relates only to a limited number of preferred embodiments of the invention which have been by way of and that it is intended to cover all changes and modifications of the examples of the invention herein chosen for the purpose of the disclosure, which do not constitute departures from the spirit and scope of the invention.

What is claimed is:

1. A transfer device for selectively combining and switching a plurality of microwave signals, comprising;

a housing having a cylindrical cavity open at one end of said housing and having four orthagonally oriented mutually rectangular walls with first, second, third and fourth ports therein respectively, opening into said cavity;

a cylindrical rotor having a central axis of rotation disposed in said cavity and turnable in succession to a first, second and third and fourth spaced position in said housing;

said rotor having portions defining at least in part a first passage having first, second and third arms aligned with and terminating at said first, third and fourth ports respectively when said rotor is in said first position, said passage providing means for propagating a first and a second microwave signal respectively applied to said first and second arms and for combining said signals in said third arm to leave said housing via said fourth port;

said rotor having second and third passages disposed in a first plane therein and defining respectively a first path for said first microwave signal between said first and second ports and a second path for said second microwave signal between said third and fourth ports when said rotor is in said second position, while said housing blocks said arms of said first passage;

said first path extending between said first and fourth ports to pass microwaves therethrough, and second path extending between said second and third ports to pass microwaves therethrough, when said rotor is in said third position, while said housing blocks said arms of said first passage, said first passage having portions of said first, second and third arms disposed in a second plane parallel to said first plane and spaced axially from said first plane;

said housing having portions blocking said second and third passages when said rotor is in said first position, to prevent switching of microwave signals in said second and third passages while microwave signals are being combined in said first passage;

whereby said rotor operates to combine microwave signals in said first passage when said rotor is in said first position, and whereby said rotor operates to switch microwave signals in said first and second paths when said rotor is turned to said second and third positions.

2. A transfer device as claimed in claim 1, wherein said portion of said first, second and third arms of first passage is wholly disposed within said rotor in said second plane.

3. A transfer device as claimed in claim 1, wherein said housing has an end wall located under said rotor and defining in part said portions of said first, second and third arms of first passage.

4. A transfer device as claimed in claim 1, wherein said rotor is turnable to said fourth position where said third arm of said first passage is aligned with and terminates at said second port, while said first and second arms are aligned with and terminate at said third and first ports respectively for emitting said combined microwave signals through said third arm, while said housing blocks off said first and second paths to prevent switching of microwave signals therein.

5. A transfer device as claimed in claim 1, wherein said housing has a cover plate closing said cavity at said one end of said housing; and a shaft secured axially to said rotor and extending through said cover plate for turning said rotor to each of said first, second, third and fourth positions.

6. A transfer device as claimed in claim 1, wherein said second and third passages are curved in directions opposite to each other in said rotor so that respective ends of said second and third passages are angularly spaced apart by ninety degrees, and so that respective ends of said second and third passages terminate at ports which are angularly spaced angularly by ninety degrees.

7. A transfer device as claimed in claim 1, wherein said first passage is T-shaped in said second plane so that ends of said arms terminate at three of said ports which are regularly spaced apart by ninety degrees when said rotor is in said first position.

8. A transfer device as claimed in claim 1, wherein said first passage is Y-shaped in said second plane so that ends of said arms terminate at three of said ports which are angularly spaced apart ninety degrees when said rotor is in said first position.

9. A transfer device as claimed in claim 8, wherein said housing has an end wall located under said rotor and defining in part said portions of said first, second and third arms of first passage.

10. A transfer device as claimed in claim 1, wherein said housing has a height which is less than a distance between opposite ports.

* * * * *